US011655822B1

(12) United States Patent
Dreiss et al.

(10) Patent No.: US 11,655,822 B1
(45) Date of Patent: May 23, 2023

(54) MULTI-STAGE PUMP OR TURBINE FOR CONTROLLING FLUIDS WITH SIGNIFICANT VARIATIONS IN GAS FRACTION

(71) Applicant: Flowserve Management Company, Irving, TX (US)

(72) Inventors: Andreas Dreiss, Geestland (DE); Bonnie M. Brezinsky, Bethlehem, PA (US); Gregory Morrison, Nazareth, PA (US); Neil Havrilla, Coplay, PA (US); Scott C. Judge, Bethlehem, PA (US)

(73) Assignee: Flowserve Pte. Ltd., Singapore (SG)

( * ) Notice: Subject to any disclaimer, the term of this patent is extended or adjusted under 35 U.S.C. 154(b) by 0 days.

(21) Appl. No.: 17/880,076

(22) Filed: Aug. 3, 2022

(51) Int. Cl.
*F04D 13/12* (2006.01)
*F01D 13/00* (2006.01)
*F04D 7/00* (2006.01)

(52) U.S. Cl.
CPC ..... *F04D 13/12* (2013.01); *F01D 13/00* (2013.01); *F04D 7/00* (2013.01); *F05D 2220/30* (2013.01)

(58) Field of Classification Search
CPC . F04D 13/12; F04D 7/00; F01D 13/00; F05D 2220/30
See application file for complete search history.

(56) References Cited

U.S. PATENT DOCUMENTS

2019/0249560 A1* 8/2019 Kuhns ..... F04D 25/045

* cited by examiner

*Primary Examiner* — Jacob M Amick
*Assistant Examiner* — Charles J Brauch
(74) *Attorney, Agent, or Firm* — Maine Cernota & Rardin

(57) ABSTRACT

A multi-stage hydraulic rotating machine (MSHRM) maintains near-optimal efficiency over widely varying conditions of service (COS) when controlling a fluid having a gas volume fraction (GVF) greater than 50% and large changes in volumetric flow rate (VFR) between stages. The MSHRM includes separately controlled stages having at least two different designs with different VFR ranges. Stage impellor differences can include impellor diameter, blade pitch, blade width, blade number, inlet diameter, and outlet diameter. Diffusers can differ in similar ways between stages. VFR ranges can be progressively higher or lower in successive stages. The stages can share a common VFR range within which incompressible liquids can be controlled. The MSHRM can function as a pump or turbine, and can be applicable to energy storage and recovery in "green" energy systems.

18 Claims, 6 Drawing Sheets

MULTI-STAGE PUMP OR TURBINE FOR CONTROLLING FLUIDS WITH SIGNIFICANT VARIATIONS IN GAS FRACTION

FIELD OF THE INVENTION

The invention relates to pumps and turbines, and more particularly, to multi-stage pumps and turbines that are required to pump and/or extract energy from multi-phase fluids over a wide range of gas fractions.

BACKGROUND OF THE INVENTION

Rotary pumps, turbines, and hybrid pump/turbines, referred to herein generically as "hydraulic rotating machines," or "HRMs," are typically able to efficiently control process fluids over a finite range of volumetric flow rates (VFRs) and pressure differentials ("heads"). The set of operating conditions or "conditions of service" (COS) under which the efficiency of an HRM is optimal is sometimes called the "best efficiency point" (BEP) of the HRM.

If the rotational speed of an HRM will be fixed, for example if the HRM will be driven by a synchronous motor that operates at the line frequency, then it is necessary to select or design an HRM for which the BEP matches a desired VFR at a specified rotational speed, head, and other specified COS. For example, the impellor diameter, inlet and outlet diameters, number of impellor blades, and/or inlet and outlet pitch of the impellor blades can be selected as needed to provide an HRM having a BEP that matches a desired VFR and head at a specified rotation rate.

For a variable speed HRM, the BEP can generally be shifted or "tuned" over a range of VFRs, referred to herein as the "VFR range" of the HRM, simply by adjusting the rotational speed of the HRM. For example, if the COS remain otherwise unchanged, it may be possible to double the VFR of the BEP simply by doubling the rotational speed of the HRM. Of course, in general the VFR range will be finite, i.e. there will be a minimum VFR and a maximum VFR between which the BEP can be tuned by varying the rotational speed of the HRM.

When a required head or pressure drop for an application is large, it can be difficult or impractical to design a single impellor HRM that can satisfy the requirement. Instead, it is common to implement a multi-stage HRM (MSHRM), which is a type of HRM that includes a plurality of stages. Typically, the stages are substantially identical to each other and arranged in series, with the impellors of the stages all being attached to a common shaft, and are thereby being operated at a common, fixed rotational speed, which is typically determined by the driving motor type and/or by the frequency of the electrical supply net.

For an MSHRM, at any given moment the mass flow rate must be the same for all of the stages. If the process fluid remains liquid and substantially incompressible as it flows through the MSHRM, then the VFR will also be the same for all of the HRM stages. However, if the process fluid includes a substantial gas void fraction (GVF), either due to gas being present in the process fluid upon entry into the MSHRM and/or due to liquid/gas phase transitions that occur within the MSHRM, then the compressible gas component of the process fluid will lead to changes in the GVF between stages, thereby requiring different VFRs in different HRM stages, even though the mass flow rate remains the same for all of the HRM stages. In some applications, liquid/gas phase transitions within the MSHRM can lead to gas void fractions of up to 50% or more, even if the process fluid enters the MSHRM as a pure liquid.

With reference to FIG. 1A, one approach is to provide an MSHRM that includes a plurality of identical HRM stages 100 having variable, independently controlled rotating speeds. With reference to FIG. 1B, for some applications efficient operation of the MSHRM can be achieved for a compressible process fluid by adjusting the speed of each of the stages to align the BEP with the required VFR for that stage.

If the GVF remains low throughout the MSHRM, then only minor adjustments of the rotating speeds of the stages will be needed. In the example of FIG. 1B, the BEP of each stage 100 is variable over a VFR range 102 between a minimum VFR 104 of 500 gallons-per-minute (gpm) at a rotating speed of 1500 rpm up to a maximum VFR 106 of 1000 gpm at a rotating speed of 3000 rpm. In the illustrated example, the first stage 108 requires a VFR of about 800 gpm, the second stage 110 about 700 gpm, the third stage 112 about 650 gpm, and the fourth stage 114 about 550 gpm. As can be seen in the figure, all of these VFR requirements fall within the VFR range of the MSHRM stages 100.

However, if the process fluid includes a large GVF, then the VFR may vary widely between stages, and it may be difficult to find a mass flow rate for which the BEP's of all of the stages can be matched to the required VFRs.

In general, the VFR range of an HRM will depend on the COS, such as the pressure differential (head) across the HRM, the fluid temperature, the fluid viscosity, and other factors. Some HRM applications require operation over a very wide COS range, which can include large changes of the fluid temperature and/or HRM pressure differential (head), and resulting large changes in GVF, such as up to 30%, 50%, or more, for example due to changes in pressure-induced and/or temperature-induced liquid/gas phase transitions. Variations in COS can also include large changes in the mass flow rate that is required through an MSHRM. As a result, in such applications it may be necessary for the stages of an MSHRM to accommodate very larges VFR changes.

For example, technologies for green energy storage and recovery can require the operation of MSHRMs over especially wide COS ranges. MSHRMs are typically used in these technologies both to store energy (pumping mode) and to recover the stored energy (turbine mode). For example, excess energy can be used to pump water from a low-lying reservoir to an elevated reservoir during times of low energy demand, and then turbines can be used to recapture the energy as the water is allowed to flow from the elevated reservoir back to the low-lying reservoir during periods of high energy demand.

Similarly, MSHRMs can be used to pressurize and/or liquify a gas within a storage container during times when excess energy is available, and then the stored gas can be allowed to vaporize and/or expand during periods of high energy demand so that it can be used to operate a turbine. For example, energy can be stored by compressing carbon dioxide into a supercritical liquid state within a holding tank, and then vaporizing the carbon dioxide and directing the resulting gas through a turbine to recover the saved energy.

As another example, MSHRMs can be used to drive heat pump cycles that store energy by heating or cooling a thermal storage medium. In each case, a separate pump and turbine can be implemented, or a dual mode pump/turbine HRM can be used to meet the requirements of both the energy storage cycle and the energy recovery cycle of an energy storage system.

In such applications the GVF within each stage of the MSHRM can vary widely. For example, when compressing a gas, the pressure differential across the MSHRM will change significantly, leading to large GVF changes. Furthermore, the energy that is available to drive a pumping system, or the energy that is required from a turbine system, can vary widely depending on a degree of energy excess or deficiency, thereby leading to widely varying requirements of mass flow rate through the MSHRM.

For such applications, it may not be possible for an MSHRM to maintain efficient operation over the required GVF range, even if the rotational speeds of the stages are independently controlled.

What is needed, therefore, is a multi-stage HRM (MSHRM) that can maintain near-optimal operating efficiency when controlling a fluid having a significant gas volume fraction (GVF) that is widely variable, thereby leading to widely varying volumetric flow rates (VFRs) that can change significantly over time and can vary substantially between the HRM stages.

SUMMARY OF THE INVENTION

The present invention is a multi-stage HRM (MSHRM) that can maintain near-optimal operating efficiency when controlling a fluid having a significant gas volume fraction (GVF) that is widely variable, thereby leading to widely varying volumetric flow rates (VFRs) that can change significantly over time and can vary substantially between the HRM stages.

The MSHRM of the present invention includes a plurality of HRM stages having rotational speeds that are separately controlled. In addition, the HRM stages include at least two stages having different designs, causing those stages to have different VFR ranges. In some embodiments, the impellor diameters are different between at least two of the stages. In other embodiments, the blade pitch, and hence the impellor width, of the impellors is different between at least two of the stages. In still other embodiments, the widths and/or number of the impellor blades, the inlet diameter, the outlet diameter, and/or the hydraulic passage widths are different between different stages. Embodiments include similar differences between diffusers of the HRM stages.

While the VFR requirements for the various stages of an MSHRM can vary widely, for many applications it can be generally expected that the required VFR will be higher for certain stages than for other stages. For example, if an MSHRM functions as a compressor and is required to compress a process fluid that includes a high GVF, there will generally be a reduction in the GVF from stage to stage as the gas in the process fluid is compressed. Conversely, for an MSHRM that functions as a turbine, there will generally be an increase in the VFR from stage to stage as the gas in the process fluid expands.

Accordingly, in many compressor embodiments, the minimum and maximum VFR for the first stage of the MSHRM are both higher than the corresponding minimum and maximum VFRs for the last stage of the MSHRM. This allows the VFR across the MSHRM to vary from the maximum VFR of the first stage down to the minimum VFR of the last stage. Conversely, in many turbine embodiments, the minimum and maximum VFRs for the first stage of the MSHRM are both lower than the corresponding minimum and maximum VFRs for the last stage of the MSHRM. This allows the VFR across the MSHRM to vary from the minimum VFR of the first stage up to the maximum VFR of the last stage.

As a simple, hypothetical example, if a steady, linear increase of the VFR is expected across the stages of an MSHRM of the present invention, then the stages might be designed such that their VFR ranges are "staggered," i.e. the VFR ranges are of similar amplitude, but offset in their minimum and maximum VFR values.

In some embodiments, there is a "common" VFR range that is overlapped by the VFR ranges of all of the stages of the MSHRM. Accordingly, these embodiments are able to efficiently control pure liquids at VFR values that lie within the common VFR range. In some other embodiments that are required to adapt to very wide VFR ranges and do not anticipate controlling a pure liquid, there is no VFR that is common to all of the VFR ranges of all of the MSHRM stages. In embodiments, there is some overlap between the VFR ranges of each pair of adjacent stages in the MSHRM.

The present invention is a multi-stage hydraulic rotating machine (MSHRM). The MSHRM includes a first stage having a first design, and a second stage having a second design that is different from the first design, said first and second designs comprising respective first and second rotatable impellors, the MSHRM being configured to control a process fluid as the process fluid flows serially through the first stage and through the second stage.

The MSHRM further includes a rotating speed of the first impellor and a rotating speed of the second impellor being independently controllable over a first speed range and a second speed range, respectively. The first design has a first best efficiency point (BEP) at which the first stage operates at maximal efficiency, said first BEP includes a first BEP volumetric flow rate (VFR) that is adjustable over a first VFR range from a first minimum VFR to a first maximum VFR by varying the rotating speed of the first impellor over the first speed range from a first minimum speed to a first maximum speed.

The second design has a second BEP at which the second stage operates at maximal efficiency, said second BEP including a second BEP VFR that is adjustable over a second VFR range from a second minimum VFR to a second maximum VFR by varying the rotating speed of the second impellor over the second speed range from a second minimum speed to a second maximum speed, and the first minimum VFR is not equal to the second minimum VFR, and/or the first maximum VFR is not equal to the second maximum VFR.

In embodiments, the first minimum VFR is greater than said second minimum VFR, and said first maximum VFR is greater than said second maximum VFR, or said second minimum VFR is greater than said first minimum VFR, and said second maximum VFR is greater than said first maximum VFR.

In any of the above embodiments, a diameter of the first impellor can be different from a diameter of the second impellor.

In any of the above embodiments, a width of the first impellor can be different from a width of the second impellor.

In any of the above embodiments, the first impellor can include a number of impellor blades that is different from a number of impellor blades of the second impellor.

In any of the above embodiments, a width of impellor blades of the first impellor can be different from a width of impellor blades of the second impellor.

In any of the above embodiments, an inlet diameter of the first stage can be different from an inlet diameter of the second stage.

In any of the above embodiments, an outlet diameter of the first stage can be different from an outlet diameter of the second stage.

In any of the above embodiments, a diffuser of the first stage can be different from a diffuser of the second stage.

In any of the above embodiments, a hydraulic passage width of the first stage can be different from a hydraulic passage width of the second stage.

In any of the above embodiments, the first and second VFR ranges can overlap, such that a common VFR range is included in both of the first and second VFR ranges.

In any of the above embodiments, the MSHRM can be configured to control a process fluid having a gas volume fraction (GVF) in at least one of the first and second stages of at least 50%.

In any of the above embodiments, the MSHRM can be configured to function as a pump, a turbine, or a hybrid pump/turbine.

In any of the above embodiments, the MSHRM can includes a third stage comprising a third rotatable impellor, the MSHRM being configured to control the process fluid as the process fluid flows serially through the first stage, through the second stage, and through the third stage, a rotating speed of the third impellor being controllable over a third speed range independently from the rotating speeds of the first and second impellors, and the third BEP including a third BEP VFR that is adjustable over a third VFR range from a third minimum VFR to a third maximum VFR by varying the rotating speed of the third impellor over the third speed range from a third minimum speed to a third maximum speed.

In some of these embodiments, the MSHRM is configured to compress the process fluid, the third minimum VFR is greater than the second minimum VFR and the third maximum VFR is greater than the second maximum VFR, and the second minimum VFR is greater than the first minimum VFR and the second maximum VFR is greater than the first maximum VFR.

In any of these embodiments, the MSHRM can be configured to extract energy from the process fluid, thereby functioning as a turbine, the third minimum VFR being less than the second minimum VFR and the third maximum VFR being less than the second maximum VFR, and the second minimum VFR being less than the first minimum VFR and the second maximum VFR being less than the first maximum VFR.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is a multi-stage HRM (MSHRM) that can maintain near-optimal operating efficiency when controlling a fluid having a significant gas volume fraction (GVF) that is widely variable, thereby leading to widely varying volumetric flow rates (VFRs) that can change significantly over time and can vary substantially between the HRM stages.

The MSHRM of the present invention includes a plurality of HRM stages 100 having rotational speeds that are separately controlled. In addition, with reference to FIG. 2, the HRM stages 100 include at least two stages 100 having different designs, causing those stages to have different VFR ranges 200, 202. In some embodiments, the impellor diameters are different between at least two of the stages. In the illustrated embodiment, stages 1 and 2 are identical to each other, and stages 3 and 4 are identical to each other, while the blade pitch, and hence the impellor width, of the impellors is different between stages 1 and 2 and stages 3 and 4. In still other embodiments, the widths and/or number of the impellor blades, the inlet diameter, the outlet diameter, and/or the hydraulic passage widths are different between different stages. Embodiments include similar differences between the diffusers of the HRM stages.

While the VFR requirements for the various stages of an MSHRM can vary widely, in many embodiments it can be expected that the VFR requirements for certain stages 100 will be higher than for other stages. For example, if an MSHRM functions as a compressor and is required to compress a process fluid that includes a high GVF, there will generally be a reduction in the GVF from stage to stage as the gas in the process fluid is compressed. Conversely, for an MSHRM that functions as a turbine, there will generally be an increase in the VFR from stage to stage as the gas in the process fluid expands.

Figure 1A:
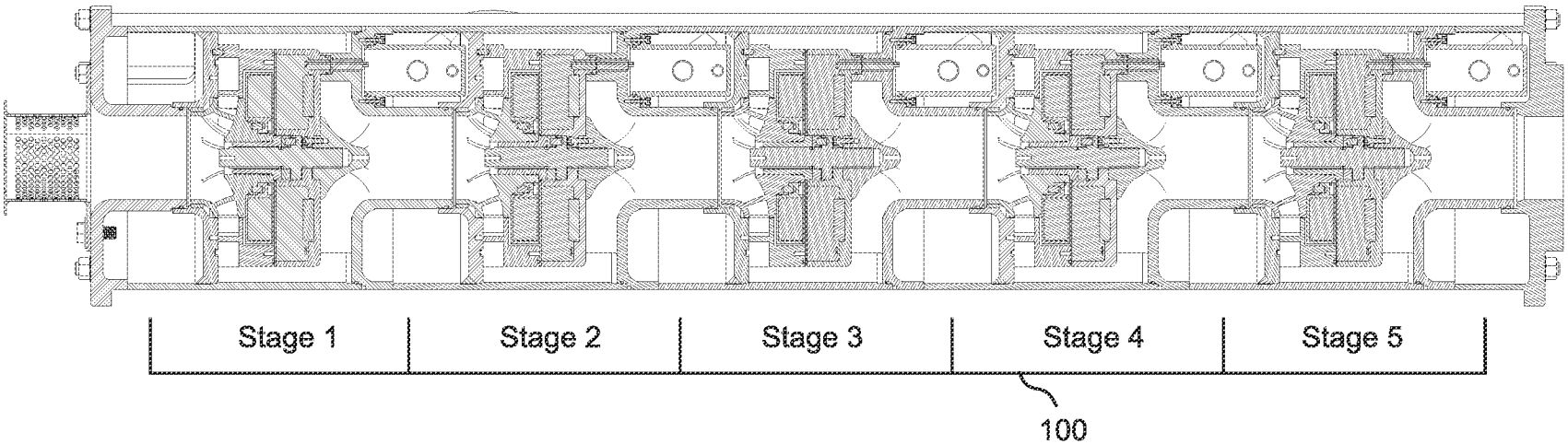
Fig. 1A (Prior art)
FIG. 1A is a cross-sectional illustration of an MSHRM of the prior art, in which all stages are identical to each other.
Figure 1B:
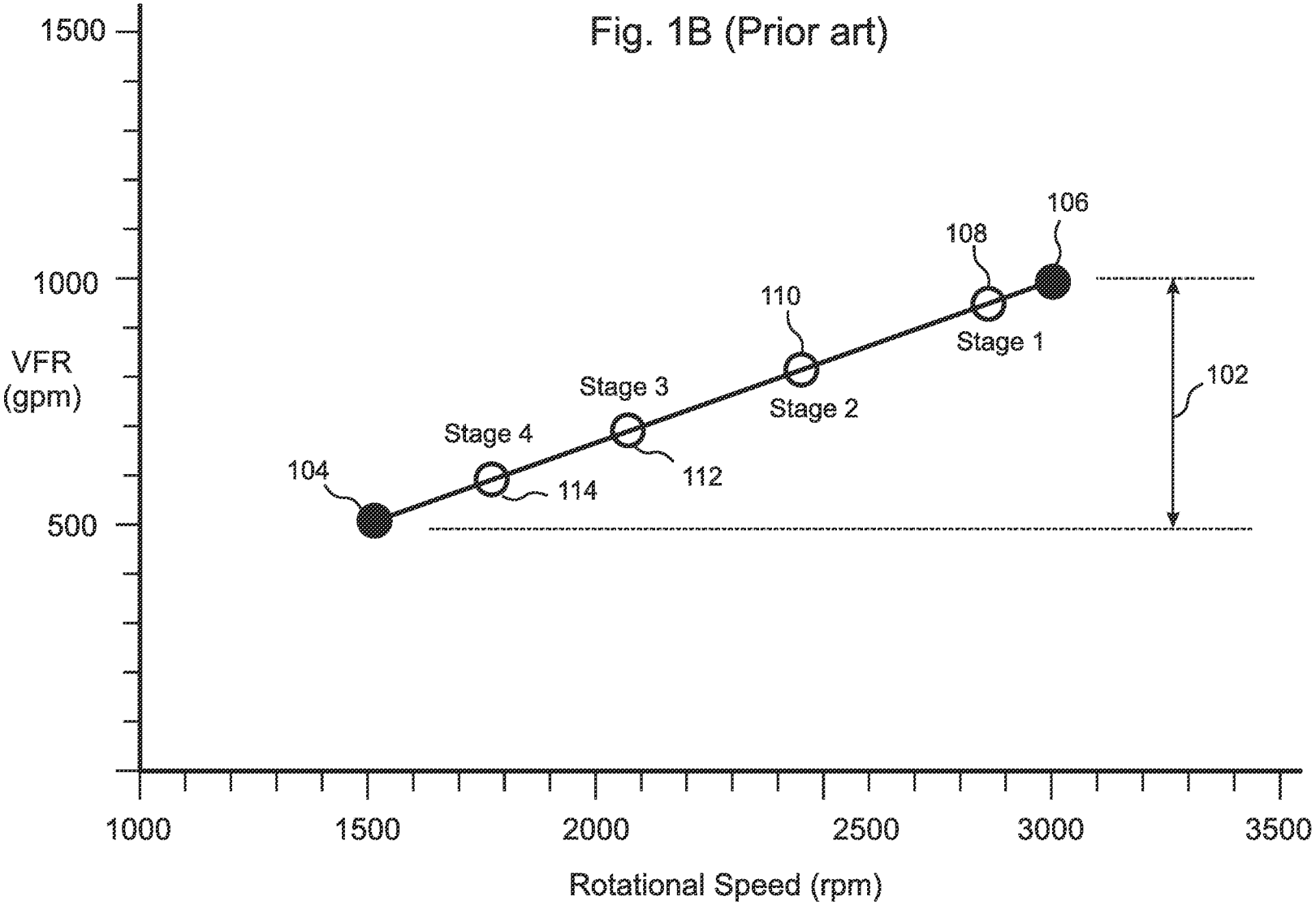
Fig. 1B (Prior art)
FIG. 1B is a graph that illustrates rotational speed settings of the MSHRM of FIG. 1A in a hypothetical example.
Figure 2:
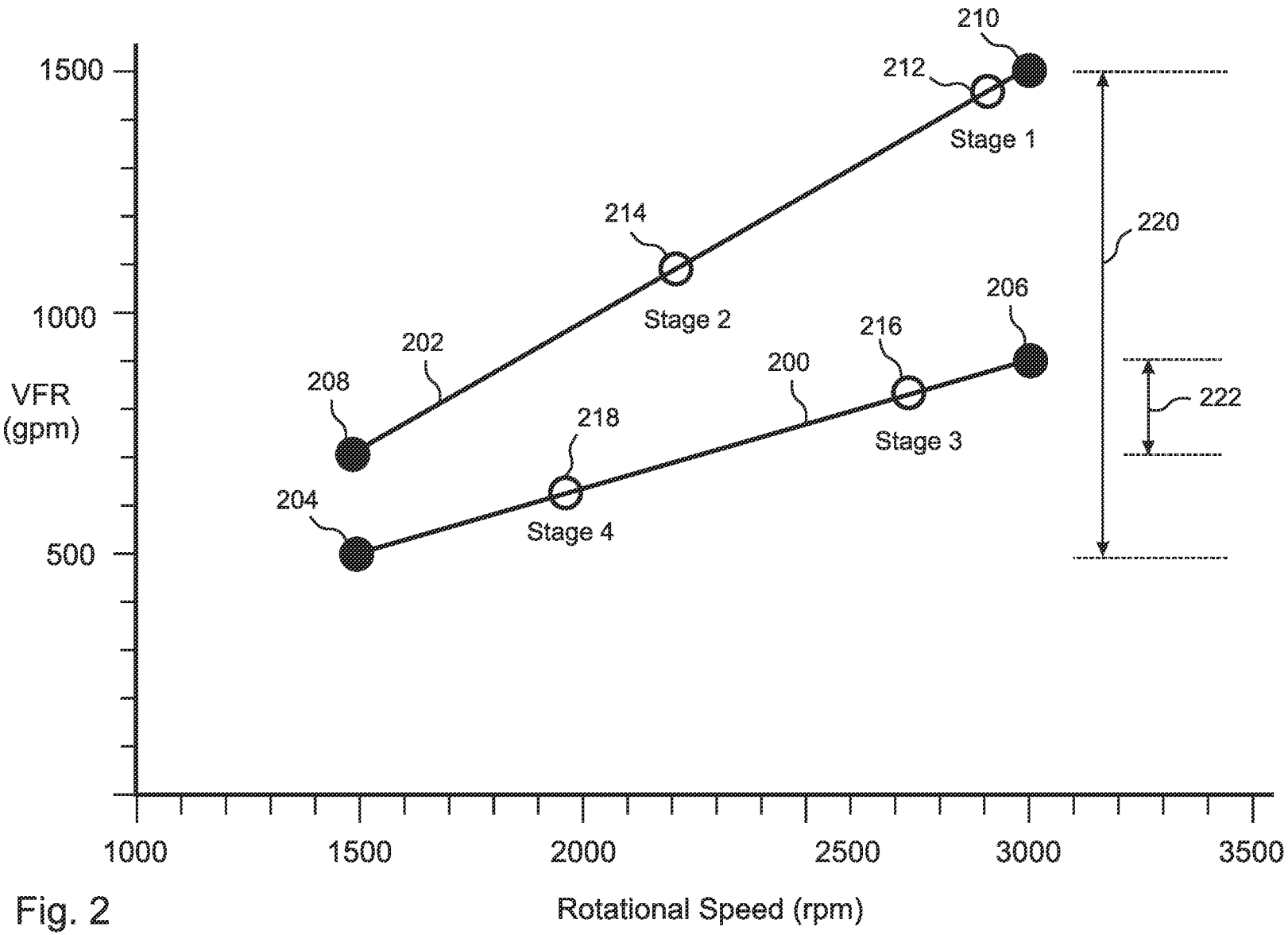
FIG. 2 is a graph that illustrates rotational speed settings for two stages having different design in a first embodiment of the present invention.

Accordingly, in the compressor embodiment of FIG. 2, the minimum VFR 208 for stages 1 and 2 is greater than the minimum VFR 204 for stages 3 and 4, and the maximum VFR 210 for stages 1 and 2 is greater than the maximum VFR 206 for stages 3 and 4. This allows the VFR across the MSHRM to vary over a VFR range 220 that extends from the maximum VFR of the first stage 210 down to the minimum VFR of the last stage 204. In the illustrated example, the operating point 212 of the first stage is at a VFR of about 1450 gpm, with a rotating speed of about 3000 rpm. The operating point 214 of the second stage is at a VFR of about 1100 gpm, with a rotating speed of about 2200 rpm. The operating point 216 of the third stage (having a different design from stages 1 and 2) is about 840 gpm, with a rotating speed of about 2750 rpm, and the operating point 218 of the fourth (and last) stage is at a VFR of about 600 gpm at a rotating speed of about 1950 rpm.

Conversely, in many turbine embodiments, the minimum and maximum VFRs for the first stage of the MSHRM will both be lower than the corresponding minimum and maximum VFR for the last stage of the MSHRM. This allows the VFR across the MSHRM to vary from the minimum VFR of the first stage up to the maximum VFR of the last stage.

In the embodiment of FIG. 2, there is a "common" VFR range 222 that is overlapped by both of the VFR ranges 200, 202 of the stages 100 of the MSHRM. Accordingly, the illustrated embodiment is able to efficiently control pure liquids at VFR values that lie within the common VFR range 222, which in the illustrated embodiment is about 700 gpm to 900 gpm.

Figure 3:
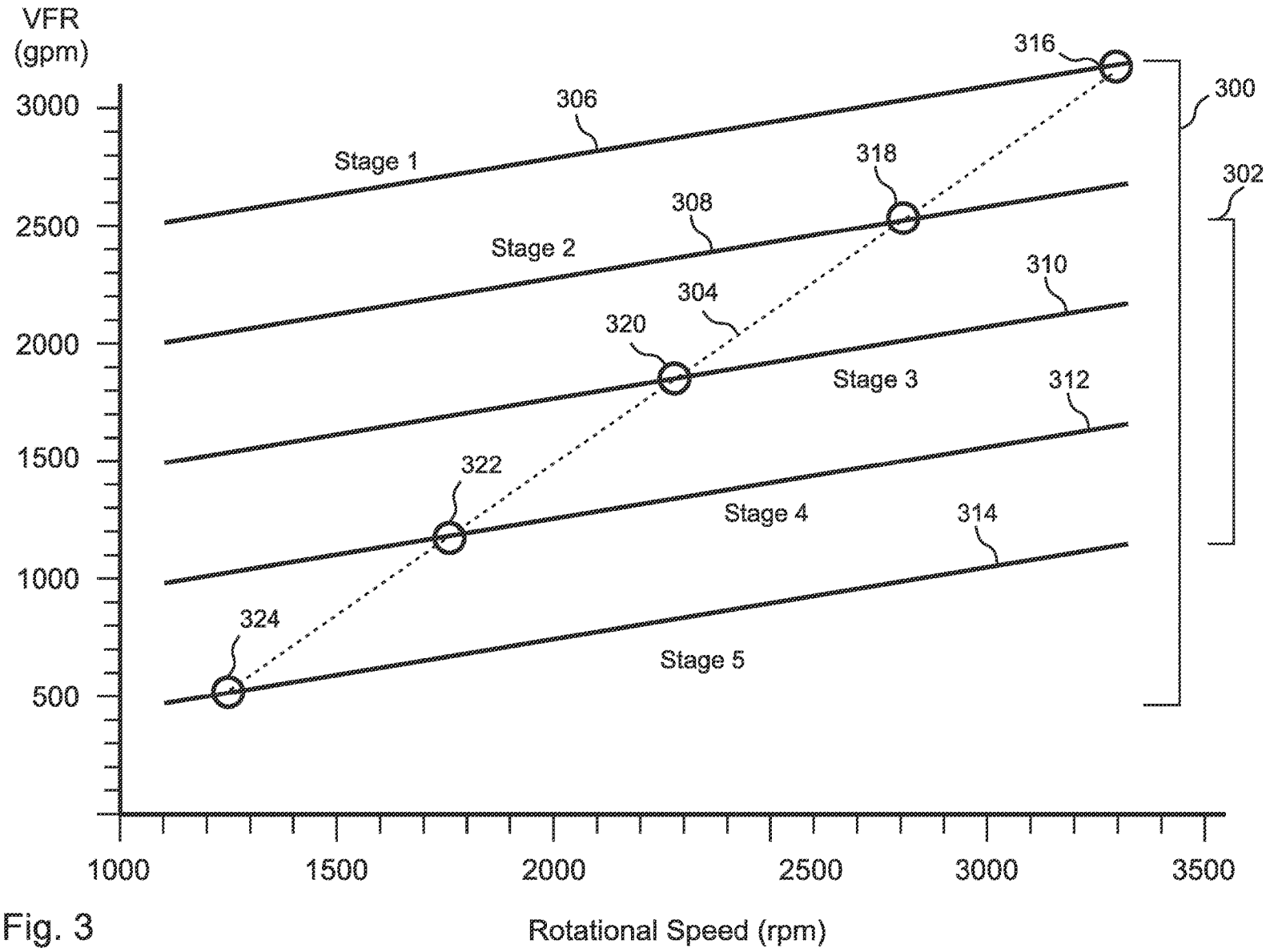
FIG. 3 is a graph that illustrates rotational speed settings for two stages having different design in a second embodiment of the present invention.

With reference to FIG. 3, in other embodiments that are required to adapt to very wide VFR ranges 300 and do not anticipate controlling a pure liquid, there is no VFR that is common to all of the VFR ranges of all of the MSHRM stages. Instead, the VFR is required to vary within the MSHRM over at least a minimum range 302. The illustrated embodiment does, however, include some overlap between the VFR ranges of each pair of adjacent stages in the MSHRM.

FIG. 3 illustrates a simple, hypothetical example in which a steady, linear increase 304 of the BEP VFR is expected across the five stages 100 of the MSHRM as a function of rotating speed. In the illustrated example, the stages are designed such that their VFR ranges 306-314 are "staggered," i.e. the BEP VFRs of the ranges 306-314 vary with the rotating speed in a similar manner, but the minimum and maximum VFR values of the ranges 306-314 are successively offset from each other In the illustrated example, the set point 316 of the first stage is at about 3200 gpm at a rotating speed of about 3200 rpm, the set point 318 of the second stage is at about 2500 gpm at a rotating speed of about 2700 rpm, the set point 320 of the third stage is at about 1900 gpm at a rotating speed of about 2200 rpm, the set point 322 of the fourth stage is at about 1200 gpm at a rotating speed of about 1750 rpm, and the set point 324 of the fifth stage is at about 3200 gpm at a rotating speed of about 3200 rpm.

Figure 4A:
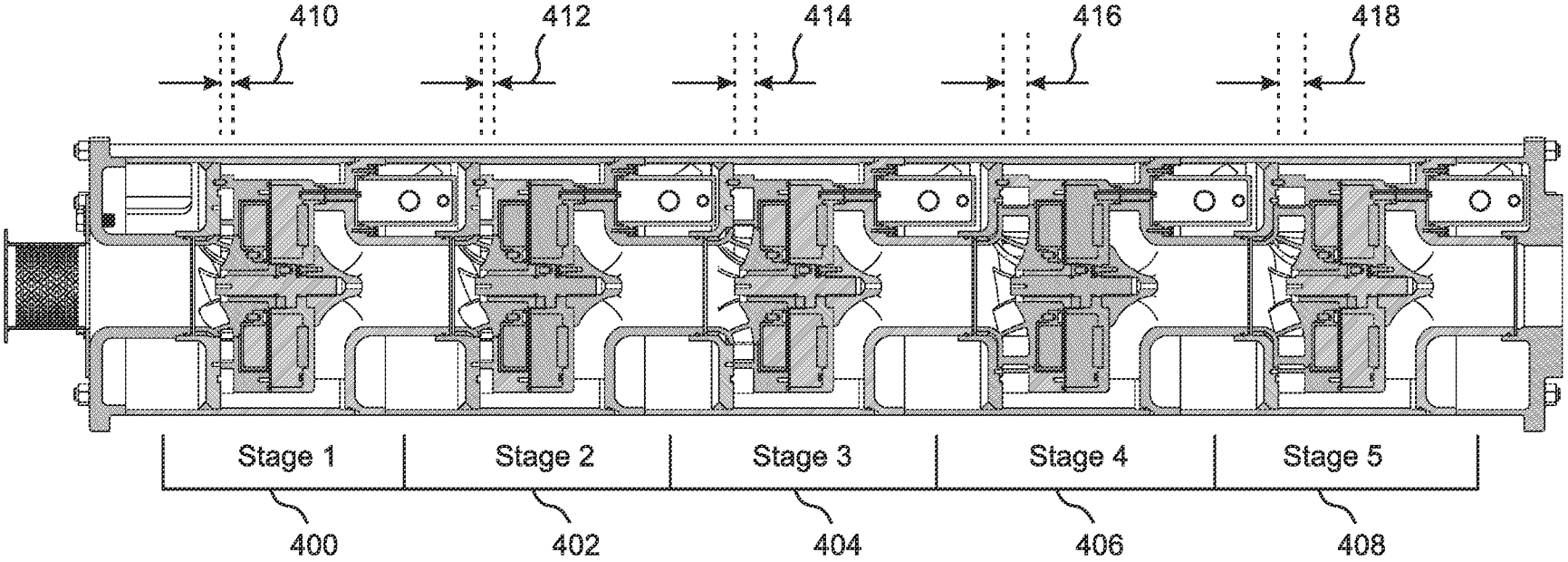
FIG. 4A is a cross-sectional illustration of a 5-stage embodiment of the present invention.

FIG. 4A is a cross-sectional illustration, drawn to scale, of an MSHRM that includes five stages 400-408, of which the first two stages 400, 402 are identical to each other, and the final two stages 406, 408 are identical to each other, the third stage 404 having a design that is different from all of the other stages 400-402, 406-408. The stages 400-408 of the illustrated MSHRM therefore include three different designs. The impellor widths 410-418 are indicated in the figure, and it can be seen that the first two impellor widths 410, 412 are the smallest and the final two impellor widths 416, 418 are the greatest, with the impellor width 414 of the third stage 404 being intermediate between the two extremes. In arbitrary units, the impellor widths are 0.65 for stages 1 and 2, 1.00 for stage 3, and 1.30 for stages 4 and 5.

Figure 4B:
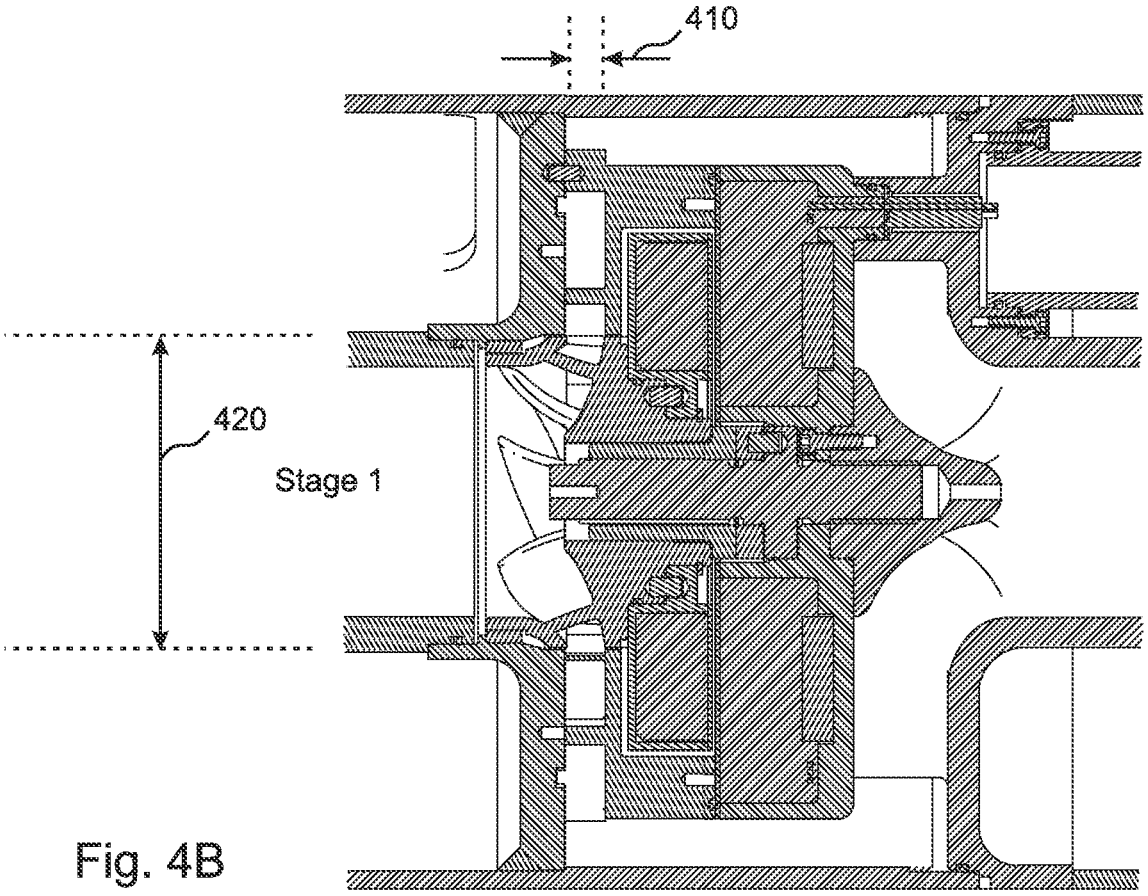
FIG. 4B is a close-up cross-sectional view of the first stage of the embodiment of FIG. 4A.
Figure 4C:
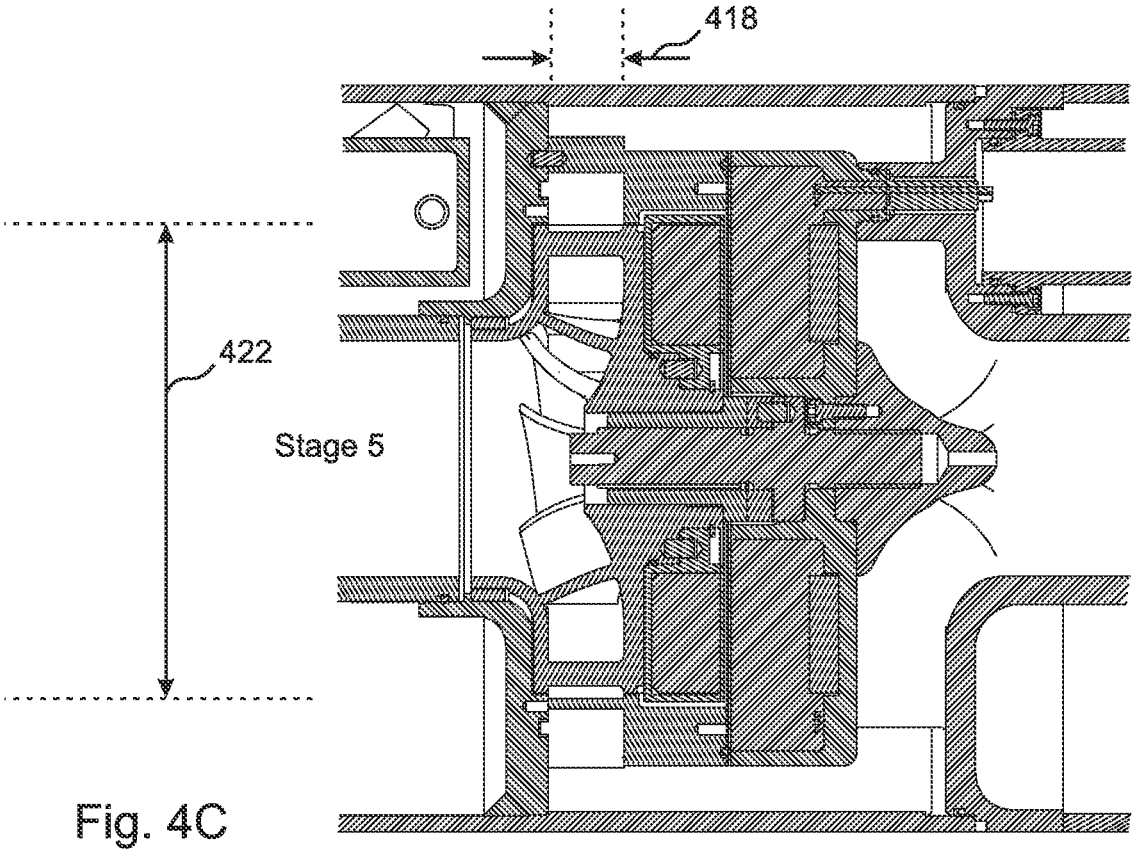
FIG. 4C is a close-up cross-sectional view of the fifth stage of the embodiment of FIG. 4A.

FIG. 4B is an expanded view of the first stage 400 of FIG. 4A, and FIG. 4C is an expanded view of the final stage 408 of FIG. 4A. In these enlarged views, the differences between the impellor widths 410, 418 can be more clearly seen. In addition, the diameters 420, 422 of the impellors are also indicated. It can be seen that the impellor diameter 420 for the first stage 400 is smaller than the impellor diameter 422 of the fifth stage 408. In arbitrary units, the impellor diameters are 5.06 for stages 1 and 2, 5.81 for stage 3, and 8.06 for stage 5.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

Although the present application is shown in a limited number of forms, the scope of the invention is not limited to just these forms, but is amenable to various changes and modifications. The disclosure presented herein does not explicitly disclose all possible combinations of features that fall within the scope of the invention. The features disclosed herein for the various embodiments can generally be interchanged and combined into any combinations that are not self-contradictory without departing from the scope of the invention. In particular, the limitations presented in dependent claims below can be combined with their corresponding independent claims in any number and in any order without departing from the scope of this disclosure, unless the dependent claims are logically incompatible with each other.

We claim:

1. A multi-stage hydraulic rotating machine (MSHRM) comprising:

a first stage having a first design, and a second stage having a second design that is different from the first design, said first and second designs comprising respective first and second rotatable impellors, the MSHRM being configured to control a process fluid as the process fluid flows serially through the first stage and through the second stage;

a rotating speed of the first impellor and a rotating speed of the second impellor being independently controllable over a first speed range and a second speed range, respectively;

said first design having a first best efficiency point (BEP) at which the first stage operates at maximal efficiency, said first BEP including a first BEP volumetric flow rate (VFR) that is adjustable over a first VFR range from a first minimum VFR to a first maximum VFR by varying the rotating speed of the first impellor over the first speed range from a first minimum speed to a first maximum speed;

said second design having a second BEP at which the second stage operates at maximal efficiency, said second BEP including a second BEP VFR that is adjustable over a second VFR range from a second minimum VFR to a second maximum VFR by varying the rotating speed of the second impellor over the second speed range from a second minimum speed to a second maximum speed; and the first minimum VFR is not equal to the second minimum VFR, and/or the first maximum VFR is not equal to the second maximum VFR.

2. The MSHRM of claim 1, wherein said first minimum VFR is greater than said second minimum VFR, and said first maximum VFR is greater than said second maximum VFR, or said second minimum VFR is greater than said first minimum VFR, and said second maximum VFR is greater than said first maximum VFR.

3. The MSHRM of claim 1, wherein a diameter of the first impellor is different from a diameter of the second impellor.

4. The MSHRM of claim 1, wherein a width of the first impellor is different from a width of the second impellor.

5. The MSHRM of claim 1, wherein the first impellor includes a number of impellor blades that is different from a number of impellor blades of the second impellor.

6. The MSHRM of claim 1, wherein a width of impellor blades of the first impellor is different from a width of impellor blades of the second impellor.

7. The MSHRM of claim 1, wherein an inlet diameter of the first stage is different from an inlet diameter of the second stage.

8. The MSHRM of claim 1, wherein an outlet diameter of the first stage is different from an outlet diameter of the second stage.

9. The MSHRM of claim 1, wherein a diffuser of the first stage is different from a diffuser of the second stage.

10. The MSHRM of claim 1, wherein a hydraulic passage width of the first stage is different from a hydraulic passage width of the second stage.

11. The MSHRM of claim 1, wherein the first and second VFR ranges overlap, such that a common VFR range is included in both of the first and second VFR ranges.

12. The MSHRM of claim 1, wherein the MSHRM is configured to control a process fluid having a gas volume fraction (GVF) in at least one of the first and second stages of at least 50%.

13. The MSHRM of claim 1, wherein the MSHRM is configured to function as a pump.

14. The MSHRM of claim 1, wherein the MSHRM is configured to function as a turbine.

15. The MSHRM of claim 1, wherein the MSHRM is configured to function as a hybrid pump/turbine.

16. The MSHRM of claim 1, wherein:

the MSHRM includes a third stage comprising a third rotatable impellor;

the MSHRM being configured to control the process fluid as the process fluid flows serially through the first stage, through the second stage, and through the third stage;

a rotating speed of the third impellor being controllable over a third speed range independently from the rotating speeds of the first and second impellors; and the third BEP including a third BEP VFR that is adjustable over a third VFR range from a third minimum VFR to a third maximum VFR by varying the rotating speed of the third impellor over the third speed range from a third minimum speed to a third maximum speed.

17. The MSHRM of claim 16 wherein:

the MSHRM is configured to compress the process fluid;

the third minimum VFR is greater than the second minimum VFR and the third maximum VFR is greater than the second maximum VFR; and the second minimum VFR is greater than the first minimum VFR and the second maximum VFR is greater than the first maximum VFR.

18. The MSHRM of claim 16 wherein:

the MSHRM is configured to extract energy from the process fluid, thereby functioning as a turbine;

the third minimum VFR is less than the second minimum VFR and the third maximum VFR is less than the second maximum VFR; and the second minimum VFR is less than the first minimum VFR and the second maximum VFR is less than the first maximum VFR.

* * * * *